United States Patent [19]

Takahashi et al.

[11] Patent Number: 4,986,448

[45] Date of Patent: Jan. 22, 1991

[54] BEVERAGE DISPENSING UNIT WITH A CONTROL UNIT FOR CONTROLLING DISPENSATION OF A BEVERAGE

[75] Inventors: Yutaka Takahashi, Kanagawa; Ikuo Harashima, Gunma; Shunichi Nakayama, Gunma; Yasuyuki Arai, Gunma; Yasushi Takayanagi, Gunma; Ryoichi Sekiguchi, Gunma; Tomomitsu Abe, Kanagawa; Hiroshi Hayakawa, Kanagawa, all of Japan

[73] Assignees: Sanden Corporation, Gunma; Kirin Brewery Co., Ltd., Tokyo, both of Japan

[21] Appl. No.: 313,504

[22] Filed: Feb. 22, 1989

[30] Foreign Application Priority Data

Feb. 22, 1988 [JP] Japan ..... 63-37407
Feb. 27, 1988 [JP] Japan ..... 63-43301

[51] Int. Cl.[5] ..... B67D 5/56

[52] U.S. Cl. ..... 222/129.1; 222/325; 222/509

[58] Field of Search ..... 222/129.1, 129.2, 129.3, 222/129.4, 509, 505

[56] References Cited

U.S. PATENT DOCUMENTS

| | | | |
|---|---|---|---|
| 3,584,762 | 6/1971 | Vantroba et al. | 222/129.1 |
| 3,653,548 | 4/1972 | Kotscha et al. | 222/129.1 |
| 3,800,826 | 4/1974 | McCann | 222/129.1 |
| 4,493,441 | 1/1985 | Sedam et al. | 222/129.1 |
| 4,635,824 | 1/1987 | Gaunt et al. | 222/129.3 |
| 4,688,701 | 8/1987 | Sedam | 222/146.6 |

FOREIGN PATENT DOCUMENTS

| | | | |
|---|---|---|---|
| 2152011 | 11/1983 | United Kingdom | 222/129.1 |

*Primary Examiner*—Andres Kashnikow
*Assistant Examiner*—Gregory L. Huson
*Attorney, Agent, or Firm*—Banner, Birch, McKie & Beckett

[57] ABSTRACT

In a beverage dispensing unit which includes a storing unit (32), a conducting arrangement (43) for conducting a beverage from the storing unit, and a cabinet (38), the storing unit comprises a portable tank which is removable from the cabinet. The conducting arrangement includes an end portion (47) which is detachably connected to the tank. The end portion is held to the cabinet to be radially movable in relation to a connecting axis defined by the cabinet. Preferably, the cabinet comprises guiding arrangement (41, 42) for guiding the tank substantially along the connecting axis. The beverage dispensing unit further comprises a controlling unit (60) for controlling dispensation of the beverage. For adjusting a flow rate of the beverage in a beverage path (62, 63, 64) which is opened and closed by a valve (75), the controlling unit comprises an adjusting member (82) having an end (**82*b*) covered with an operating member (90**) which operates the valve. The operating member is movable to expose the end of the adjusting member, so that it is readily possible to adjust the flow rate of the beverage.

9 Claims, 9 Drawing Sheets

BEVERAGE DISPENSING UNIT WITH A CONTROL UNIT FOR CONTROLLING DISPENSATION OF A BEVERAGE

BACKGROUND OF THE INVENTION

This invention relates to a dispensing unit for dispensing a beverage, such as water or the like and, in particular, to a controlling unit included in the dispensing unit for controlling dispensation of the beverage.

Various dispensing units of this type are already known. For example, a dispensing unit as a post-mix beverage dispenser is disclosed in U.S. Pat. Nos. 4,493,441 and 4,688,701 issued to Jason K. Sedam et al and assigned to The Coca-Cola Company. As will presently be described, the dispensing unit comprises a cabinet, a water reservoir, a cooling unit, a conducting unit, and a controlling unit which are fixedly assembled to a cabinet.

The water reservoir is for storing an original beverage, namely, drinking water and may therefore be called a storing unit. The cooling unit is combined with the storing unit for cooling the original beverage therein The original beverage is sent from the storing unit towards the controlling unit through the conducting unit.

It is advantageous that the beverage dispenser can be placed in a limited space, and therefore the cabinet may be compact. However, it is difficult to supply the original beverage into the storing unit of such a compact dispenser.

Such a controlling unit is disclosed in Japanese U.M. Publication No. 51-18189 issued to Fukuo Mochizuki. The controlling unit comprises a body defining a beverage path which is connected to the above-mentioned conducting unit. The beverage path is provided with a valve member and an adjusting member. The valve member is for controlling the opening and closing of the beverage path. The adjusting member is for changing a cross-sectional area of the beverage path to adjust a flow rate of the beverage in the beverage path.

The valve member is connected to an operating member which is placed on a front surface of the body. When the operating member is operated by an operator or a user, the valve member is driven to open the beverage path. As a result, the above-mentioned mixed beverage is discharged from the controlling unit.

The adjusting member has an operating end which is exposed on a rear surface of the body to be operable for adjusting the flow rate. However, it is difficult and inconvenient for the operator to operate the adjusting member because the cabinet covers the rear surface of the body together with the operating end of the adjusting member.

SUMMARY OF THE INVENTION

It is therefore an object of the present invention to provide a beverage dispensing unit which is capable of being readily supplied with a beverage.

It is another object of this invention to provide a controlling unit which is capable of readily adjusting a flow rate of the beverage through a beverage path.

Other objects of this invention will become clear as the description proceeds.

According to an aspect of this invention, there is provided a dispensing unit for dispensing a beverage. The dispensing unit includes storing means for storing the beverage, conducting means coupled to the storing means for conducting the beverage from the storing means, and supporting means for supporting the storing means. The conducting means includes an end portion which is detachably connected to the storing means. The supporting means has a connecting axis. In the improvement, the storing means is removable from the supporting means. The dispensing unit further comprises holding means for holding the end portion to be radially movable in relation to the connecting axis, and fixing means coupled to the holding and the supporting means for fixing the holding means to the supporting means.

According to another aspect of this invention, there is provided a controlling unit for controlling dispensation of a beverage through a beverage path. The controlling unit includes a body defining the beverage path, valve means coupled to the beverage path for controlling the opening and closing of the beverage path, an operating member coupled to the valve means for operating the valve means, and an adjusting member having an end portion coupled to the beverage path for adjusting a flow rate of the beverage in the beverage path. The body has a principal surface. The operating member has a back surface which generally faces the principal surface. In the improvement, the adjusting member has another end portion which is disposed to face the back surface so that the other end portion of the adjusting member is covered with the operating member The operating member is movable from a position where the back surface generally faces the principal surface to another position so that the other end portion of the adjusting member is uncovered with the operating member.

DETAILED DESCRIPTION OF THE PREFERRED EMBODIMENTS

Figure 1:
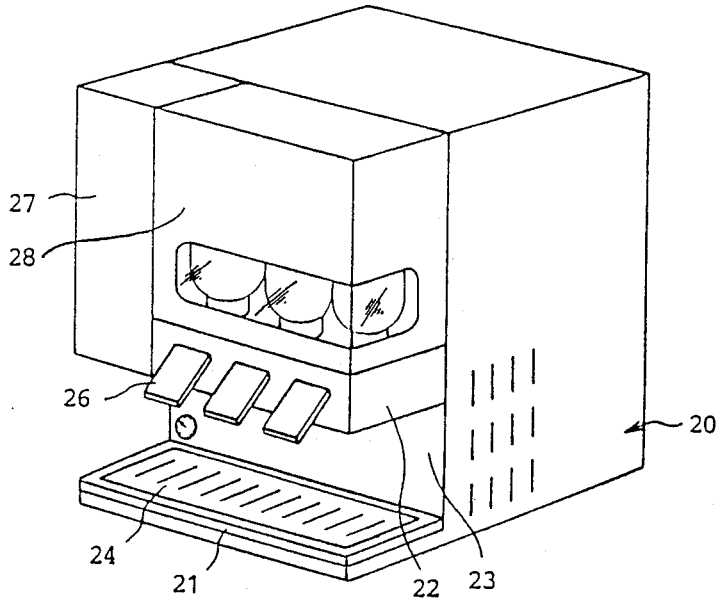
FIG. 1 is a perspective view of a beverage dispensing unit according to an embodiment of this invention.

Referring to FIG. 1, a dispensing unit for dispensing a beverage according to an embodiment of the present invention is illustrated and includes a cabinet 20, a supplying station 21, and a dispensing portion 22 The cabinet 20 is of a rectangular parallelopiped shape and has a front surface 23. Supplying station 21 is fixedly attached to a lower part of the front surface of cabinet 20 and includes a tray 24 for receiving thereon a cup (not shown). Dispensing portion 22 is placed over supplying station 21 and protrudes from front surface 23 of cabinet 20.

Dispensing portion 22 is provided with a plurality of, for example, three operating members 26. A combination of dispensing portion 22 and at least one of the operating members 26 is referred to as a controlling unit which will be described later in the description.

In addition, cabinet 20 is provided with left and right doors 27 and 28 at an upper part of front surface 23.

Figure 2:
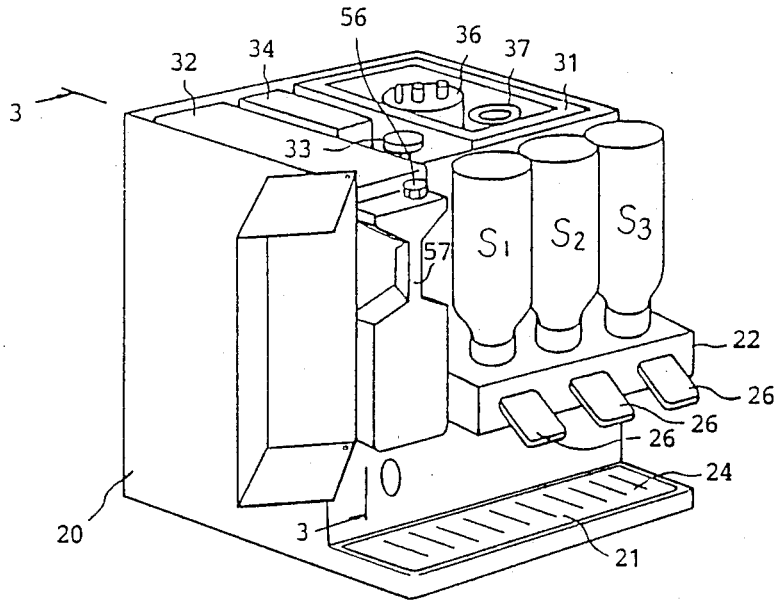
FIG. 2 is a perspective view of the beverage dispensing unit illustrated in FIG. 1, as viewed in a different direction, with a left door open and a cabinet top plate and a right door removed.

Referring to FIG. 2 in addition to FIG. 1, cabinet 20 contains therein a water reservoir 31, a portable tank 32, a $CO_2$ gas cylinder 33, and a control box 34. The water reservoir 31 is made of a heat insulation material and is fixedly disposed in a right side space in cabinet 20. Cooling water is stored in water reservoir 31. The water reservoir 31 is shown with a top plate removed to enable its inside to be viewed thereof. The water reservoir 31 is provided with a carbonator 36 and a cooling pipe, namely, an evaporator 37 therein. The carbonator 36 is for producing carbonated water in the manner known in the art. The evaporator 37 is for cooling the cooling water. The cooling water serves to cool the carbonator 36.

In addition, water reservoir 31 is provided with an aqitator and an ice detector, which are not shown in the figure for simplification of illustration. The agitator is for agitating the cooling water. The ice detector is for detecting, in the manner known in the art, whether or not ice is produced in water reservoir 31.

Each of the portable tank 32, the $CO_2$ gas cylinder 33, and the control box 34 are disposed in a left side space in cabinet 20 The portable tank 32 is for storing an original beverage, namely, drinking water and is referred to as a storing arrangement. The original beverage has a part supplied to carbonator 36 after it is cooled by the cooling water. The portable tank 32 is removable from the cabinet 21 after the left door 27 is opened. The $CO_2$ gas cylinder 33 is for storing a $CO_2$ gas or liquid therein and is changeable to a fresh one. A portion of the $CO_2$ gas is supplied to carbonator 36. The control box 34 is for controlling operation of the dispensing unit in the manner known in the art.

A plurality of syrup tanks S1, S2, and S3 are connected to dispensing portion 22 as will later be described in detail. The syrup tanks S1 through S3 correspond to operating members 26, respectively. Each of the syrup tanks S1 through S3 is for storing a syrup and is changeable to a fresh one after the right door 28 is opened.

The dispensing unit 22 further comprises a pump and a refrigeration circuit, which are not shown in the figure. The pump is for sending the original beverage towards dispensing portion 31. The refrigeration circuit comprises a compressor and a condenser in addition to the evaporator a is known in the art.

Figure 3:
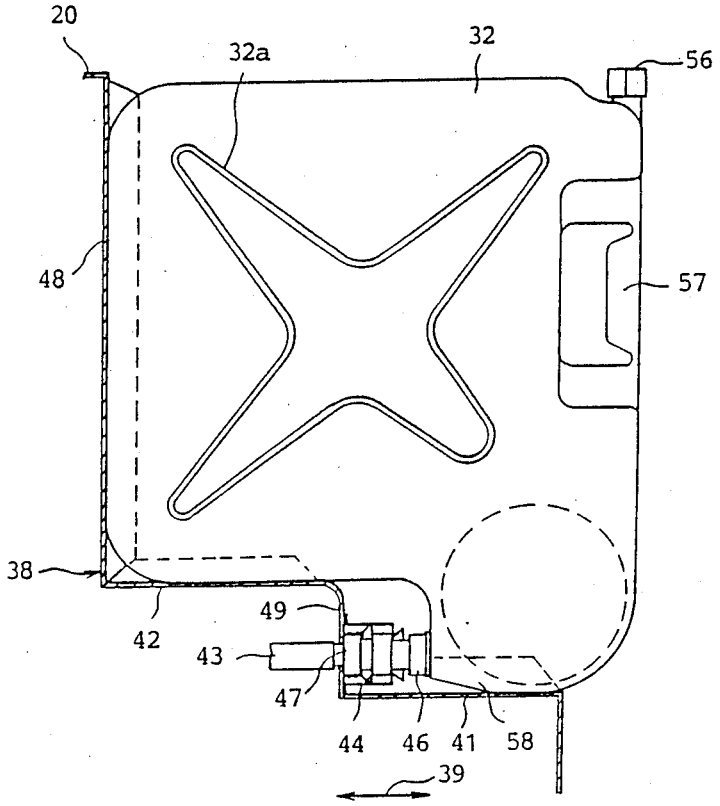
FIG. 3 is a sectional view taken along lines 3—3 in FIG. 2.

Referring to FIG. 3, cabinet 20 is provided with a supporting member 38 for supporting portable tank 32. When portable tank 32 is attached to or detached from cabinet 20, portable tank 32 is moved in a predetermined horizontal direction 39. In order to guide the horizontal movement of portable tank 32, supporting member 38 comprises first and second guiding portions 41 and 42. Each of the first and the second guiding portions 41 and 42 defines a groove which fits a lower portion of portable tank 32 to make portable tank 32 slidable in the predetermined horizontal direction 39.

The portable tank 32 is disconnectably connected to a pipe 43 through a seal coupler 44. The seal coupler 44 comprises a connecting portion 46 and an end portion 47 which can be detachably fitted to each other. The connecting portion 46 has a predetermined axis and is provided on the portable tank 32 for discharging the original beverage therefrom. The end portion 47 is connected to the pipe 43. A combination of pipe 43 and end portion 47 is referred to as a conducting arrangement.

It is a matter of course that the original beverage may flow through the seal, coupler towards pipe 43 without causing leakage therefrom when connecting portion 46 is fitted in end portion 47. When connecting portion 46 is detached from the end portion 47, each of the connecting and the end portions 46 and 47 is automatically closed to stop an outflow of the original beverage.

The supporting member 38 further comprises a positioning portion 48 and a vertical plate portion 49, each extending in a first predetermined direction, namely, a vertical direction. The positioning portion 48 is for positioning the portable tank 32 at a predetermined position in cabinet 20. The vertical plate portion 49 has a connecting axis extending in the predetermined horizontal direction 39.

Figure 4:
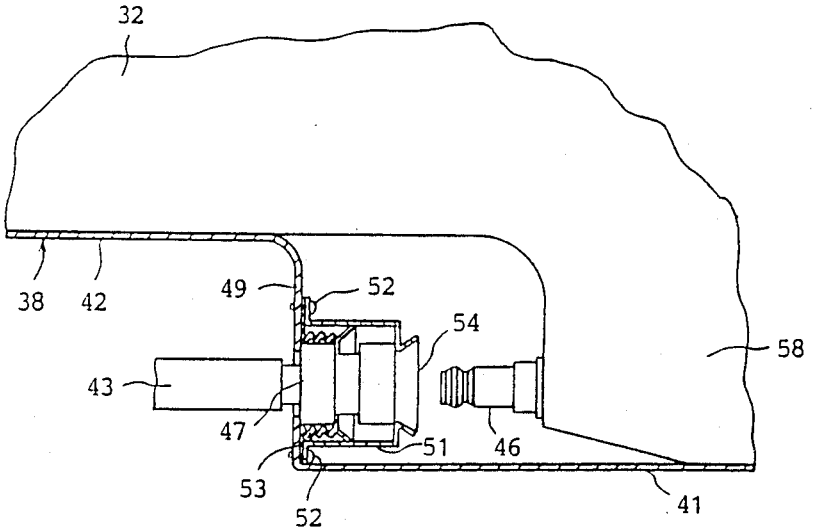
FIG. 4 is a partial enlarged sectional view of a portion in FIG. 3.

Referring to FIG. 4, illustrating a state in which connecting portion 46 is detached from end portion 47, vertical plate portion 49 is between the first and the second guiding portions 41 and 42 and serves to mount end portion 47. In order to mount end portion 47, a cylindrical member 51 is fixedly secured to vertical plate portion 49 by a fixing arrangement of, for example, a plurality of machine screws 52.

The end portion 47 is held by an urging member 53 having an end which is fixedly secured to the vertical plate portion 49 by the machine screws 52. Another end of urging member 53 is in contact with an inner surface of cylindrical member 51. The urging member 53 has elasticity and is for urging end portion 47 towards the connecting axis of the vertical plate portion 49. As a result, end portion 47 is slightly movable in a radial direction in relation to the connecting axis. A combination of the cylindrical and the urging members 51 and 53 is referred to as a holding arrangement.

The cylindrical member 51 has a free end which is provided with an additional guiding member 54. The additional guiding member 54 is for guiding connecting portion 46 when portable tank 32 is moved in the predetermined horizontal direction 39. As a result, the predetermined axis of connecting portion 46 is adjusted to be substantially on the connecting axis of end portion 47.

Figure 5:
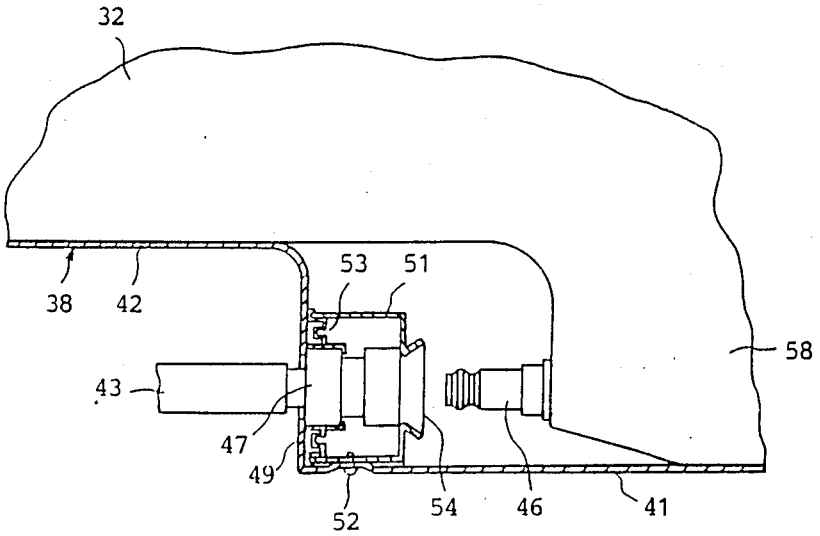
FIG. 5 is a partial enlarged sectional view similar to FIG. 4 of a beverage dispensing unit according to a modified embodiment of this invention.

The urging member 53 may be modified as is illustrated in FIG. 5. In addition, the cylindrical member 51, may be fixed to the first guiding portion 41.

Figure 6:
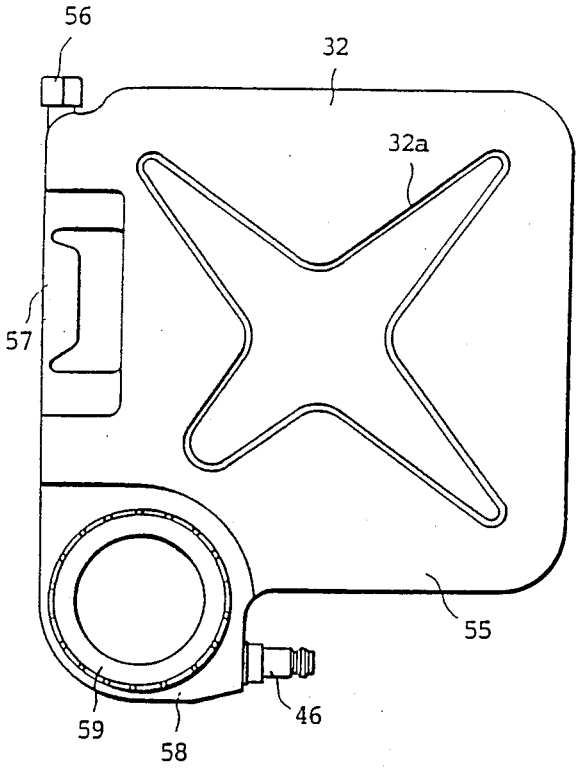
FIG. 6 is a right side view of a portable tank included in the beverage dispensing unit of FIGS. 1 and 2.
Figure 7:
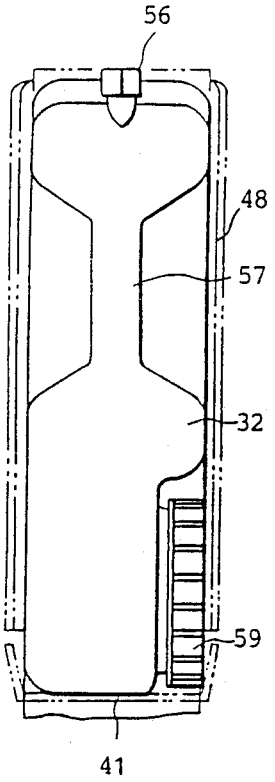
FIG. 7 is a front view of the portable tank illustrated in FIG. 4.
Figure 8:
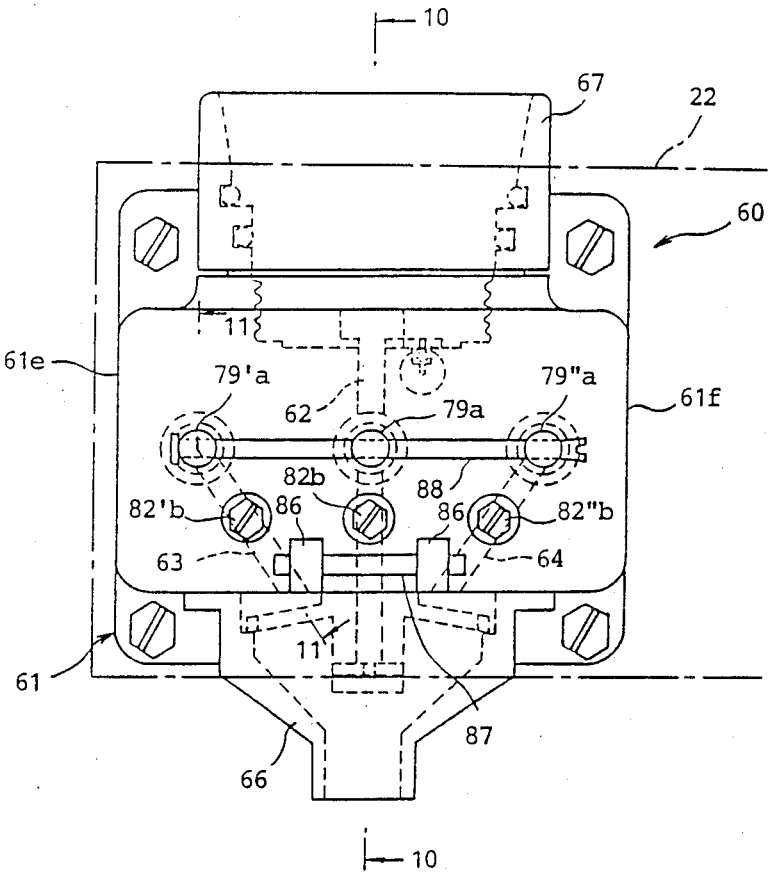
FIG. 8 is a front view of a controlling unit included in the beverage dispensing unit of FIGS. 1 and 2.
Figure 9:
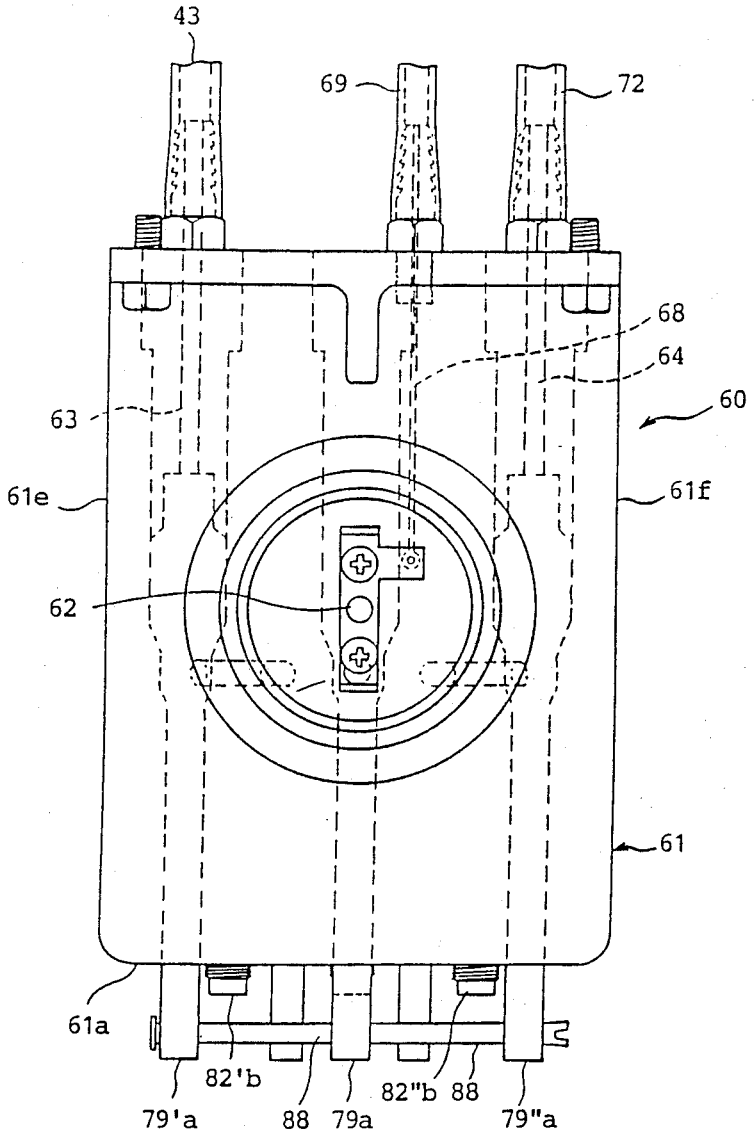
FIG. 9 is a plan view of the controlling unit illustrated in FIG. 8.

Referring to FIGS. 6 and 7, description will be made about portable tank 32 The portable tank 32 comprises a hollow tank member 55, a first cap 56, a handle 57, a supplying portion 58, and a second cap 59. The hollow tank member 55 is of a rectangular parallelopiped shape. The first cap 56 is detachably set on a top surface of hollow tank member 55 and has a blowhole which is well known in the art. The handle 57 is placed under first cap 56. The supplying portion 58 is placed on a lower portion of hollow tank member 55. The second cap 59 is detachably set on one of left and right side surfaces of hollow tank member 55. The second cap 59 may be mounted on a front surface of the hollow tank member 55. A numeral 32*a* is representative of a reinforcing portion.

With this structure, it is possible to additionally supply the original beverage into portable tank 32 in a station which is apart from cabinet 20. When portable tank 32 is set into cabinet 20, connecting portion 46 is connected to the end portion 47. As a result, it becomes possible to send, as an original water, another part of the original beverage from portable tank 32 towards the dispensing portion 22 through the pipe 43. In this event, it is preferable to cool a part of the pipe 43 by the cooling water in the water reservoir 31.

Referring to FIGS. 8 through 11 in addition to FIG. 2, attention will be directed to dispensing portion 22 The dispensing portion 22 comprises a plurality of, for example, three controlling units. But only one of the controlling units is shown in the figures for simplification of the drawing and is depicted at 60. The controlling unit 60 comprises a body 61 defined by front, rear, upper, bottom, left side, and right side surfaces 61*a*, 61*b*, 61*c*, 61*d*, 61*e*, and 61*f*. The body 61 defines syrup, original water, and carbonated water paths 62, 63, and 64 and is fixed to a frame 65 of cabinet 20 by screws or the like.

The syrup path 62 extends substantially in a vertical direction along a central portion of the body 61 and has an inlet and an outlet opening which open at the upper and the bottom surfaces 61*c* and 61*d*, respectively. The original and the carbonated water paths 63 and 64 extend along left and right sides of the syrup path 62, respectively. Each of the original and the carbonated water paths 63 and 64 has an inlet and an outlet opening which open at the rear and the bottom surfaces 61*b* and 61*d*. The outlet openings of each of those paths 62, 63, and 64 communicate with a discharge tube 66 which is attached to a bottom surface 61*d* of the body 61.

The body 61 is provided with a socket member 67 for detachably holding therein syrup tank S1. The socket member 67 is detachably mounted on upper surface 61*c* of body 61 and is changed dependent on a size of syrup tank S1. The inlet opening of syrup path 62 is placed at an inside of the socket member 67.

Figure 10:
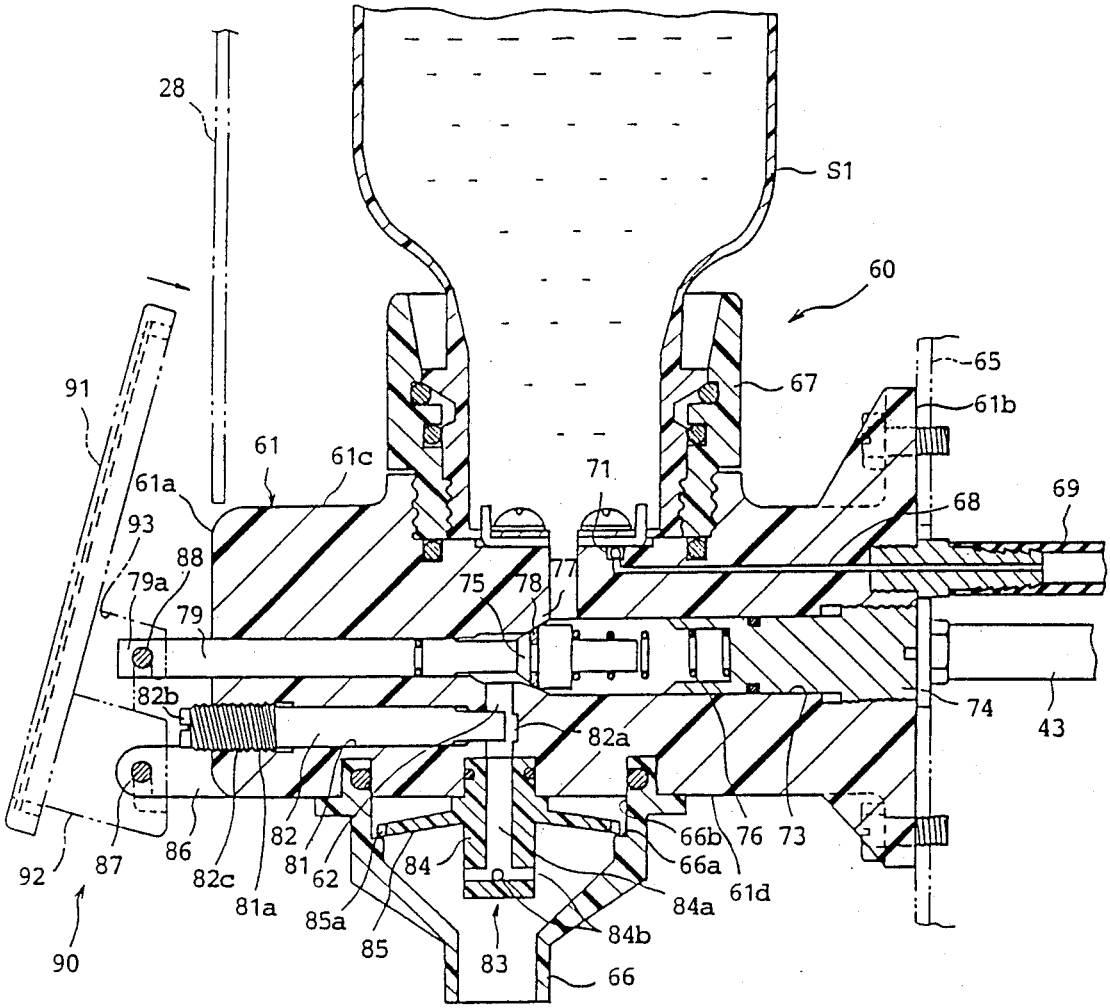
FIG. 10 is a sectional view of the controlling unit taken along a line 10—10 in FIG. 8.

In body 61, a gas path 68 is made to extend from rear surface 61*b* to the inside of socket member 67 as is best shown in FIG. 10. The gas path 68 is connected to the $CO_2$ gas cylinder 33 through a pipe 69 and is for supplying another part of the $CO_2$ gas into the syrup tank S1 through a check valve 71 in order to push out the syrup therefrom into syrup path 62. As a result, syrup path 62 serves to conduct the syrup as a beverage towards discharge tube 66.

The original water path 63 is connected at the inlet opening thereof to pipe 43 and serves to conduct the original water as the beverage towards discharge tube 66.

Similarly, the carbonated water path 64 is connected at the inlet opening thereof to a pipe 72 which is connected to carbonator 36. The carbonated water path 64 serves to conduct the carbonated water as the beverage moves towards discharge tube 66.

In FIG. 10, body 61 has a cylindrical hole 73 which communicates with the syrup path 62 and which is open at the rear surface 61*b*. A closing member 74 is screwed in cylindrical hole 73.

The controlling unit 60 further comprises a valve 75 placed in the cylindrical hole 73 for controlling the opening and closing of syrup path 62. The valve 75 is forwardly urged by a spring 76 which is placed between valve 75 and closing member 74. As a result, valve 75 is in press contact with a valve seat 77 to close the syrup path 62. In order to positively close syrup path 62, a seal member 78 is mounted on valve 75.

The valve 75 is fixedly connected to a valve rod 79 which is held by the body 61 and is movable in the predetermined horizontal direction 39. The valve rod 79 has an end 79*a* which projects forwardly from front surface 61*a*. When the valve rod 79 is backwardly moved, the valve 75 is displaced to open the syrup path 62.

The body 61 has an adjusting hole 81 which extends from front surface 61*a* to syrup path 62 in the predetermined horizontal direction 39. The adjusting hole 81 has an internal threaded portion 81*a*.

The controlling unit 60 further comprises an adjusting member 82 inserted into adjusting hole 81. The adjusting member 82 has an end portion 82*a* for adjusting a flow rate of the syrup in syrup path 62 Another end 82*b* of the adJusting member 82 protrudes forwardly from front surface 61*a* of body 60. The adjusting member 82 has an external threaded portion 82*c* which is screwed in the internal threaded portion 81*b*.

When adjusting member 82 is rotated by the use of a driving member or a screw driver (not shown), it is displaced in the predetermined horizontal direction. As a result, adjustment is carried out of the flow rate of the syrup in the syrup path 62.

Figure 11:
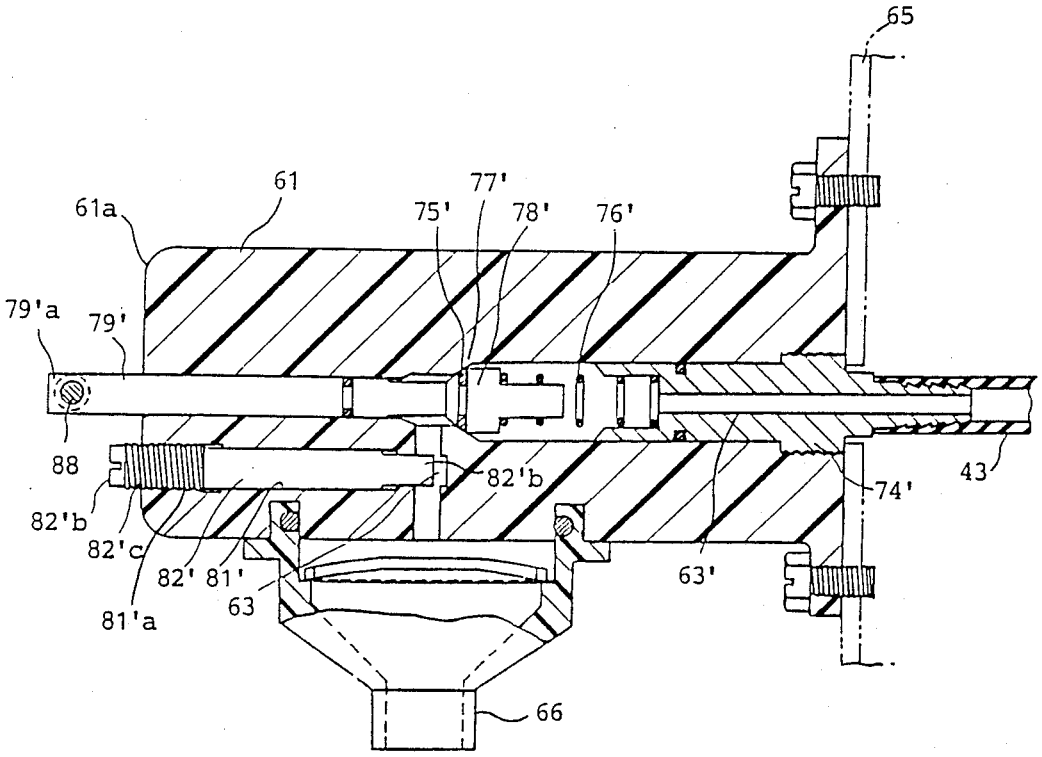
FIG. 11 is a sectional view of the controlling unit taken along a line 11—11 in FIG. 8.

In FIG. 11, the controlling unit 60 is further provided with similar parts in connection with the original water path 63 which are designated by like reference numerals added with dashes. A closing member 74' has a through hole 631 which serves as a part of the original water path 63.

When a valve rod 79' is backwardly moved, the valve 75' is displaced to open the original water path 63. When adjusting member 82' is rotated, it is displaced in the predetermined horizontal direction As a result, control and adjustment are carried out of the original water in the original water path 63.

Although description will be omitted, similar construction is provided in connection with the carbonated water path 64. Therefore, similar control and adjustment are possible in connection with the carbonated water.

Mixing is carried out among the syrup, the original water, and the carbonated water in an interior of discharge tube 66. In order to favorably carry out the mixing, the discharge tube 66 is provided with a mixing member 83 in its interior.

Figure 12:
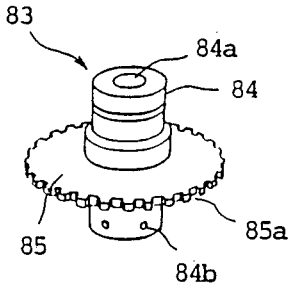
FIG. 12 is a perspective view of an agitating member included in the controlling unit of FIGS. 8 to 11.

Referring to FIG. 12, mixing member 83 comprises a cylindrical member 84 and a ring-shaped plate 85 fixed onto an outer peripheral surface of cylindrical member 84. The cylindrical member 84 has a central hole 84*a* and a plurality of small side holes 84*b* extending from the outer peripheral surface of the cylindrical member 84 to the central hole 84*a*. The cylindrical member 84 is connected to body 61 so that central hole 84a communicates with syrup path 62.

The ring-shaped plate 85 has a great number of grooves 85a in a peripheral surface thereof and is supported on a shoulder 66a formed on the inner peripheral surface of the discharge tube 66. As a result, ring-shaped plate 85 is placed under the outlet opening of each of the original and the carbonated water paths 63 and 64. In addition, the peripheral surface of ring-shaped plate 85 faces an inner peripheral surface 66b of the discharge tube 66 to produce a guiding small hole therebetween for guiding the original and the carbonated water.

Returning to FIGS. 8 through 11, body 61 is provided with two arms 86 fixedly mounted on front surface 61a thereof for fixedly holding a shaft 87. The shaft 87 has a pivot axis extending in an additional horizontal direction which intersects the first predetermined horizontal direction 39.

The valve rods 79, 79', and 79" are connected with one another through a pin rod 88 in front of front surface 61a of body 61.

Figure 13:
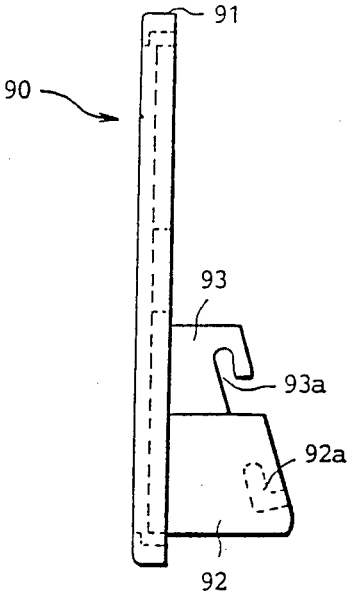
FIG. 13 is a side view of an operating member included in the beverage dispensing unit of FIGS. 1 and 2.
Figure 14:
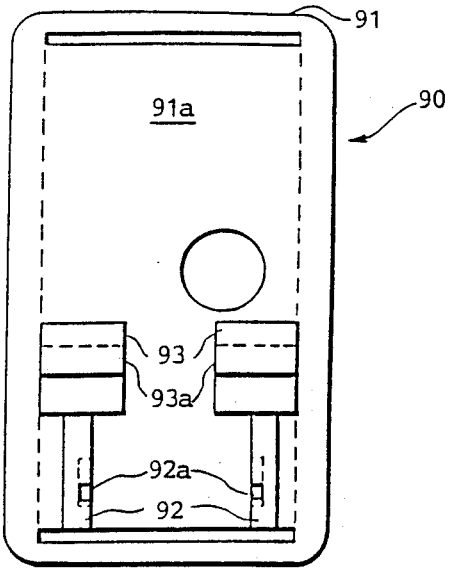
FIG. 14 is a rear view of the operating member illustrated in FIG. 13.

The controlling unit 60 further comprises an operating member 90 which is operated by an operator or a user. Referring to FIGS. 13 and 14 in addition to FIG. 10, the operating member 90 comprises a plate portion 91, two attaching portions 92, and two hooking portions 93 as will presently be described. The plate portion 91 has a back surface 91a placed to generally face front surface 61a of body 61. Therefore, the end portions 82b, 82'b, and 82"b of the adjusting members 82, 82', and 82"are covered plate portion 91.

Each of the attaching portions 92 is formed integral with back surface 91a of plate portion 91 and has an attaching groove 92a for receiving both ends of shaft 87 therein. The attaching groove 92a is extended to permit movement of the operating member 90 in the first predetermined direction. A combination of the arms 86, the shaft 87 , and the attaching portions 92 serves to pivotally support the plate portion 91 and may therefore be referred to as pivotally supporting means.

Each of the hooking portions 93 is formed integral with back surface 91a of plate portion 91 and has a hooking groove 93a for receiving pin rod 88 therein to hook hooking portion 93 with pin rod 88. The hooking groove 93a is extended so that the hooking portion is removable from pin rod 88 when the operating member 90 moved upwardly.

When plate portion 91 is pushed rearwardly by an operator or a user, operating member 90 is pivotally moved around shaft 87 Responsive to operation of the operating member 90, the valve rods 79, 79', and 79" are moved rearwardly to open the syrup, the original water, the carbonated water paths 62, 63, and 64. As a result, the syrup, the original water, the carbonated water are discharged in the discharged tube 66 and then mixed with one another therein to produce a mixed beverage The mixed beverage is discharged from discharge tube 66 into the cup.

If adjustment is desired of the flow rate of the syrup, the hooking portions 93 are removed with the operating member 90 moved upwardly Then, an upper part of the plate portion 91 is pulled forwardly so that the operating member 90 is pivotally moved downwardly around the shaft 87. As a result, plate portion 91 does not cover end portion 79a of adjusting member 79. In other words, end portion 79a of adjusting member 79 is exposed ahead the body 61. Therefore, adjusting member 79 can be readily operated to adjust the flow rate of the syrup through the syrup path 61.

It is a matter of course that similar operations can be carried out to adjust the flow rate of each of the original and the carbonated water.

Figure 15:
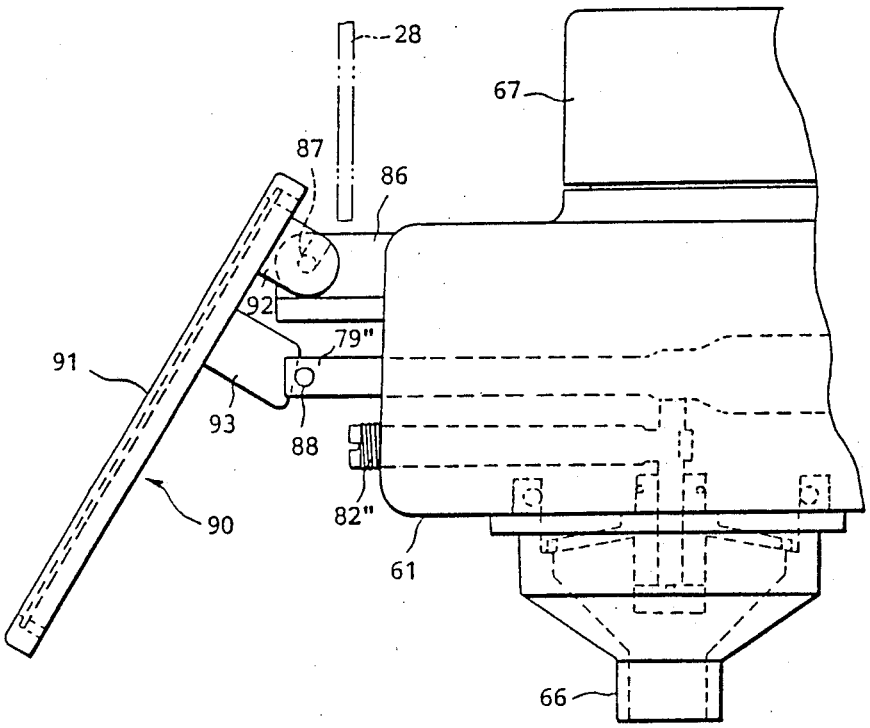
FIG. 15 is a partial side view of a controlling unit included in a beverage dispensing unit according to another embodiment of this invention.

Referring to FIG. 15, description is made of a controlling unit according to another embodiment. The controlling unit 60 comprises similar parts designated by like reference numerals. In the controlling unit, the arms 86 are provided at an upper portion of the front surface 61a of the body 61. In addition, the operating member 90 is pivotally mounted at an upper part thereof to the arms 86.

While the present invention has thus far been described in connection with only preferable embodiments thereof, it will readily be possible for those skilled in the art to put this invention into practice in various other manners. For example, the shaft may be mounted to extend in the vertical direction.

We claim:

1. In a dispensing unit for dispensing a beverage, including storing means for storing said beverage, conducting means coupled to said storing means for conducting said beverage from said storing means, and supporting means for supporting said storing means, said conducting means including an end portion which is detachably connected to said storing means, said supporting means having a connecting axis, the improvement wherein said storing means is removable from said supporting means; and said dispensing unit further comprising:

holding means for holding said end portion of said conducting means so that said end portion is radially movable about said connecting axis; and fixing means coupled to said holding and said supporting means for fixing said holding means to said supporting means.

2. A dispensing unit as claimed in claim 1, wherein said supporting means comprises guiding means for guiding said storing means in a predetermined direction which is substantially parallel to the connecting axis of said supporting means, said storing means comprising a connecting portion having a predetermined axis which is parallel to said predetermined direction, said connecting portion being connected to said end portion to be detachable from said end portion when said storing means is moved in said predetermined direction.

3. A dispensing unit as claimed in claim 2, further comprising additional guiding means for guiding said connecting portion with said storing means moved in said predetermined direction so that the predetermined axis of said connecting portion is adjusted to be substantially on the connecting axis of said supporting means.

4. A dispensing unit as claimed in claim 3, further comprising additional fixing means coupled to said additional guiding means for fixing said additional guiding means to said supporting means.

5. A dispensing unit as claimed in claim 2, wherein said holding means comprises urging means coupled to said end portion and said fixing means for urging said end portion towards the connecting axis of said supporting means.

6. In a controlling unit for controlling dispensation of a beverage through a beverage path, said controlling unit including a body defining said beverage path, valve means coupled to said beverage path for controlling the opening and closing of said beverage path, an operating member coupled to said valve means for operating said valve means, and an adjusting member having an end portion coupled to said beverage path for adjusting a flow rate of said beverage in said beverage path, said body having a principal surface, said operating member having a back surface which generally faces said principal surface, the improvement wherein said adjusting member has another end portion which is disposed to face said back surface so that the other end portion of said adjusting member is covered by said operating member, said operating member being movable from a position where said back surface generally faces said principal surface to another position so that the other end portion of said adjusting member is uncovered by said operating member when said operating member is moved to the other position.

7. A controlling unit as claimed in claim 6, said beverage path extending in a first predetermined direction, wherein said body has a hole extending from said principal surface to said beverage path in a second predetermined direction which intersects said first predetermined direction, said adjusting member being inserted into said hole to be movable in said second predetermined direction.

8. A controlling unit as claimed in claim 7, wherein said hole has an internal threaded portion, said adjusting member having an external threaded portion which is screwed in said internal threaded portion.

9. A controlling unit as claimed in claim 6, wherein said operating member comprises a plate portion opposite to other end portion of said adjusting member;

said controlling unit further comprising:

pivotal supporting means coupled to said body and said plate portion for pivotally supporting said plate portion on a pivot axis extending along a third predetermined direction which intersects said second predetermined direction; and means for removably coupling said plate portion with said valve means.

* * * * *